US008237341B2

(12) United States Patent
Freeman et al.

(10) Patent No.: US 8,237,341 B2
(45) Date of Patent: Aug. 7, 2012

(54) SPARK IGNITION DEVICE WITH BRIDGING GROUND ELECTRODE AND METHOD OF CONSTRUCTION THEREOF

(75) Inventors: Robert D. Freeman, Monclova, OH (US); Karina C. Havard, Seattle, WA (US)

(73) Assignee: Federal-Mogul Ignition Company, Southfield, MI (US)

( * ) Notice: Subject to any disclaimer, the term of this patent is extended or adjusted under 35 U.S.C. 154(b) by 186 days.

(21) Appl. No.: 12/749,570

(22) Filed: Mar. 30, 2010

(65) Prior Publication Data

US 2010/0244651 A1 Sep. 30, 2010

Related U.S. Application Data

(60) Provisional application No. 61/165,216, filed on Mar. 31, 2009.

(51) Int. Cl.
*H01T 13/46* (2006.01)
*H01J 9/00* (2006.01)

(52) U.S. Cl. ..... 313/141; 445/7; 445/35; 123/169 EL

(58) Field of Classification Search ..... None
See application file for complete search history.

(56) References Cited

U.S. PATENT DOCUMENTS

| | | | | |
|---|---|---|---|---|
| 1,160,911 | A | 11/1915 | Latch | |
| 1,359,767 | A | 11/1920 | Thomas | |
| 1,361,462 | A | 12/1920 | Hoffmann | |
| 1,400,276 | A | 12/1921 | Flood | |
| 1,413,478 | A | 4/1922 | Hough | |
| 1,441,444 | A | 1/1923 | Mitchell | |
| 1,842,834 | A | 1/1932 | Leonard | |
| 2,296,033 | A | 9/1942 | Heller | |
| 4,476,412 | A * | 10/1984 | Nishida et al. | 313/130 |
| 5,697,334 | A | 12/1997 | Below | |
| 5,918,571 | A | 7/1999 | Below | |
| 6,104,130 | A | 8/2000 | Below | |
| 6,628,050 | B1 * | 9/2003 | Kameda et al. | 313/143 |
| 2002/0017847 | A1 | 2/2002 | Kato | |
| 2002/0063504 | A1 | 5/2002 | Hori | |
| 2005/0174025 | A1 | 8/2005 | Okamoto | |
| 2006/0055297 | A1 | 3/2006 | Koyama | |
| 2007/0252502 | A1 | 11/2007 | Wang | |

FOREIGN PATENT DOCUMENTS

| | | | |
|---|---|---|---|
| EP | 0134355 | | 3/1985 |
| JP | 2006-128076 | A | 5/2006 |
| KR | 10-2008-0088514 | A | 10/2008 |

* cited by examiner

*Primary Examiner* — Ashok Patel
(74) *Attorney, Agent, or Firm* — Robert L. Stearns; Dickinson Wright, PLLC

(57) ABSTRACT

A spark ignition device and method of construction is provided. The device includes a ceramic insulator and a metal shell surrounding at least a portion of the ceramic insulator. The metal shell extends along a central axis between an upper terminal end and a lower fastening end. The fastening end has a pair of projections diametrically opposite one another extending axially to free ends. A center electrode assembly is received at least in part in the ceramic insulator. In addition, the device includes an elongate ground electrode having opposite sides extending along a length of the ground electrode between opposite ends. The ground electrode has opposite faces with a sparking surface attached to one of the faces, wherein the face with the sparking surface attached thereto is sunk axially into the free ends of the projections with at least a portion of the opposite sides being surrounded by the projections.

16 Claims, 3 Drawing Sheets

FIG. 2
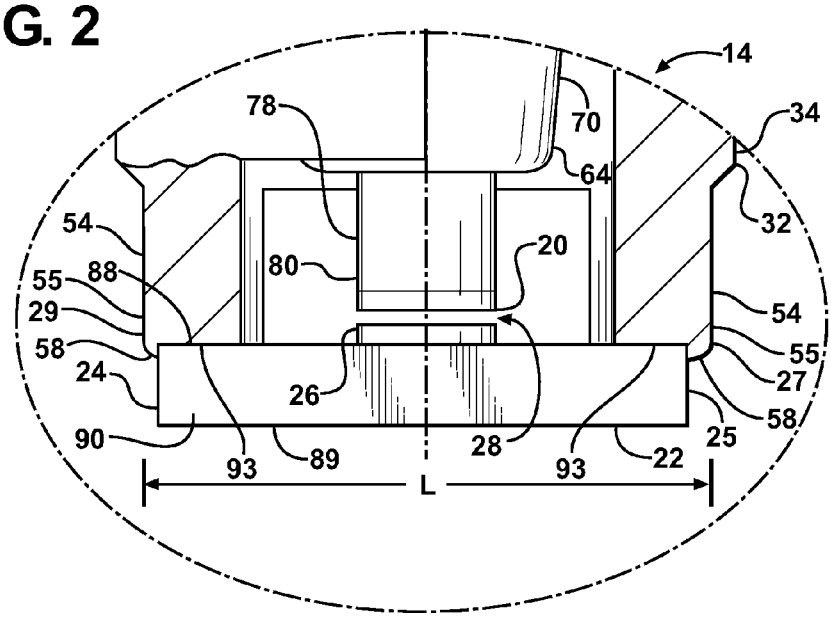
FIG. 2A
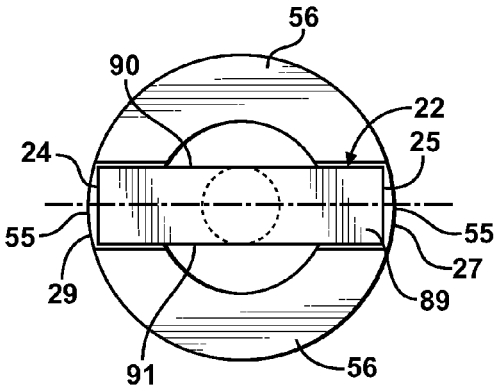
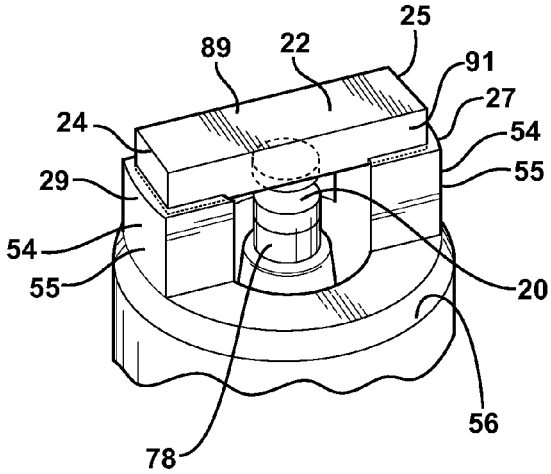
FIG. 2B
FIG. 3
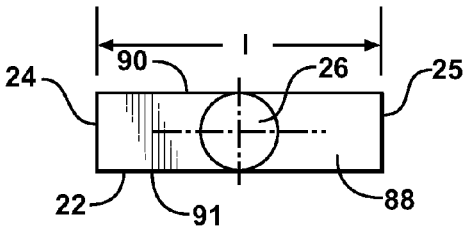
FIG. 3A
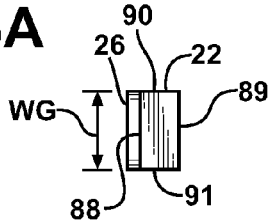

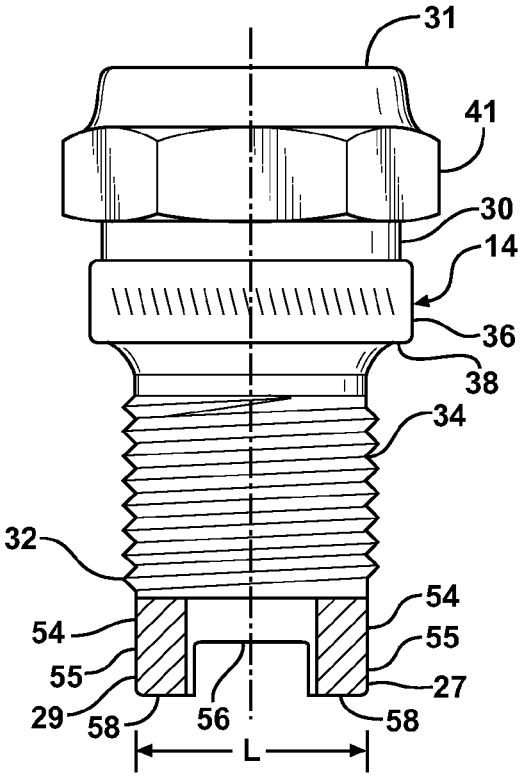
FIG. 4
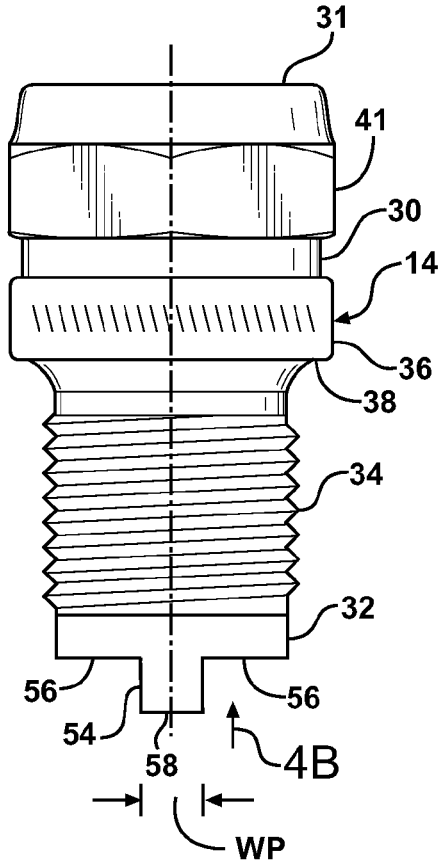
FIG. 4A
FIG. 4B
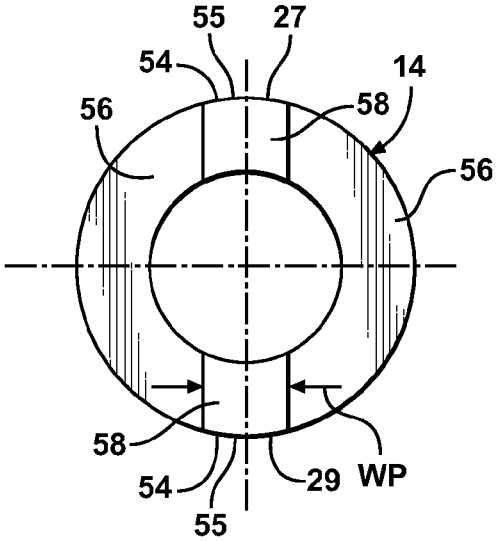

SPARK IGNITION DEVICE WITH BRIDGING GROUND ELECTRODE AND METHOD OF CONSTRUCTION THEREOF

CROSS-REFERENCE TO RELATED APPLICATION

This application claims the benefit of U.S. Provisional Application Ser. No. 61/165,216, filed Mar. 31, 2009, which is incorporated herein by reference in its entirety.

BACKGROUND OF THE INVENTION

1. Technical Field

This invention relates generally to spark ignition devices, including spark plugs for internal combustion engines, and more particularly to their ground electrode sparking surfaces and methods of construction thereof.

2. Related Art

Spark plugs used for automotive, industrial and/or marine internal combustion engine applications typically have a center electrode terminating at a sparking tip that is spaced opposite a ground electrode sparking tip across a spark gap. The sparking tips are commonly subject to relative torsional and axial movement, electrical erosion and chemical corrosion due to their construction and operating environment. As the tips move and/or wear, the sparking gap can change and the performance of the spark plug can deteriorate over time.

SUMMARY OF THE INVENTION

According to one aspect of the invention, a spark ignition device is provided. The device includes a ceramic insulator and a metal shell surrounding at least a portion of the ceramic insulator. The metal shell extends along a central axis between an upper terminal end and a lower fastening end. The fastening end has a substantially planar surface extending transversely to the central axis and a pair of projections diametrically opposite one another extending axially from the substantially planar surface away from the terminal end to free ends. Further, a center electrode assembly is received at least in part in the ceramic insulator. In addition, the device includes an elongate ground electrode having opposite sides extending along a length of the ground electrode between opposite ends. The ground electrode has opposite faces with a sparking surface attached to one of the faces, wherein the one face with the sparking surface attached thereto is sunk axially into the free ends of the projections with at least a portion of the opposite sides being surrounded by the projections.

In accordance with another aspect of the invention, a method of constructing a spark ignition device is provided. The method includes providing a ceramic insulator; disposing a center electrode assembly having a sparking surface at least in part in the ceramic insulator; providing an annular metal shell having a central axis extending between an upper terminal end and a lower fastening end and forming a pair of projections extending axially from a substantially planar surface adjacent the fastening end to free ends; providing an elongate ground electrode having opposite sides extending along a length between opposite ends and having opposite faces with a sparking surface attached to one of the faces; and sinking the ground electrode into the free ends of the projections in a welding process and bringing the sparking surface of the ground electrode into a predetermined spaced relation with the sparking surface of the center electrode to form a spark gap therebetween.

In accordance with another aspect of the invention, the ground electrode is welded to the ends of the projections using a resistance welding process.

In accordance with another aspect of the invention, opposite ends are recessed in pockets formed in the ends of the shell projections during the welding process.

In accordance with another aspect of the invention, recessed pockets are formed in the shell projections for receipt of the ground electrode prior to attaching the ground electrode to the projections.

The ground electrode is maintained in a desired fixed position relative to the center electrode with the ends of the ground electrode being at least partially surrounded by projection material. As such, the spark ignition device provides a spark gap having a precise and uniform axial width that is maintained over an extended useful life. Accordingly, the device constructed in accordance with the invention exhibits a long and useful life.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

FIG. 2 shows and enlarged cross-sectional view of the encircled area 2 of FIG. 1;

FIG. 2A shows a partial bottom view of a sparking end of the spark ignition device of FIG. 1;

FIG. 2B shows a partial perspective view of the sparking end of the spark ignition device of FIG. 1;

FIG. 3 shows a top view of a ground electrode assembly of the spark ignition device of FIG. 1;

FIG. 3A shows a side view of the ground electrode assembly of FIG. 3;

FIGS. 4 and 4A show side views rotated 90 degrees relative to one another of an outer metal shell of the spark ignition device of FIG. 1 prior to attaching the ground electrode assembly thereto; and FIG. 4B shows a partial bottom view of the metal shell of FIGS. 4 and 4A.

DETAILED DESCRIPTION OF PRESENTLY PREFERRED EMBODIMENTS

Figure 1:
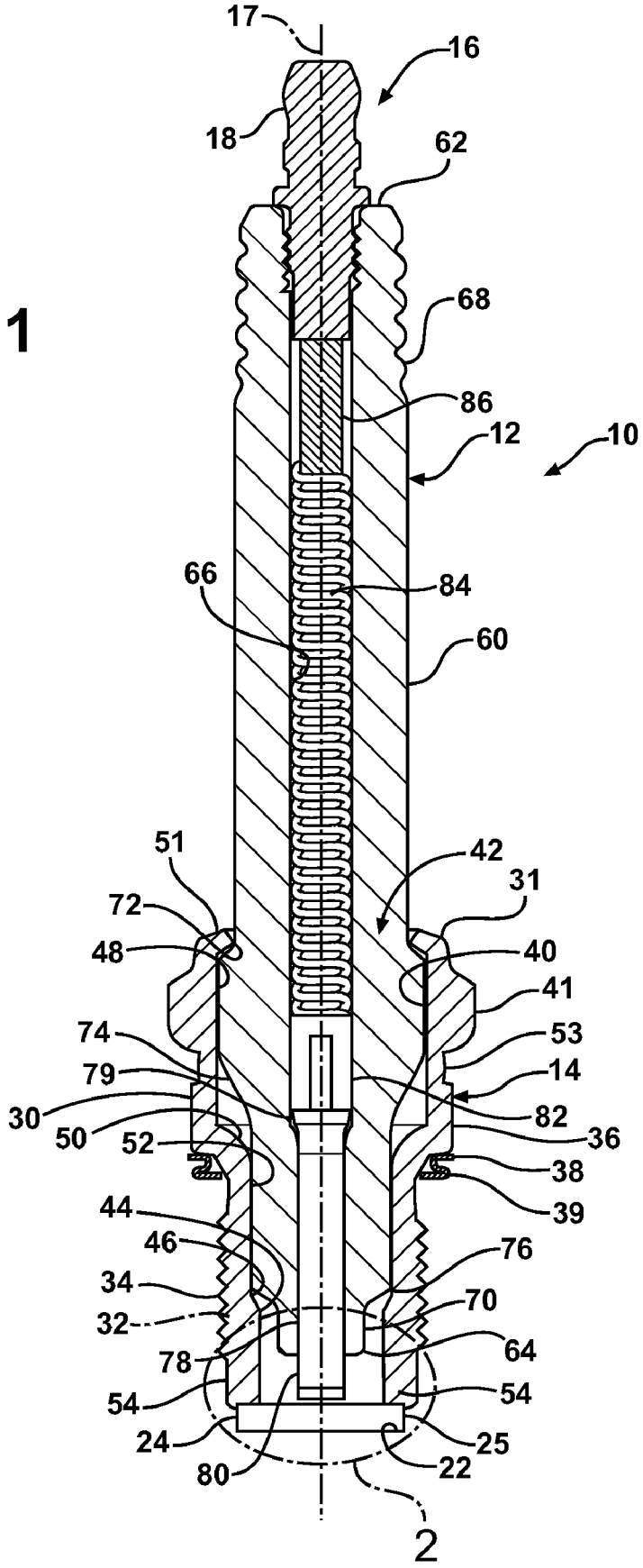
FIG. 1 shows a cross-section view taken along a central longitudinal axis of a spark ignition device constructed in accordance with one presently preferred aspect of the invention.

Referring in more detail to the drawings, FIG. 1 illustrates a spark ignition device, represented as an internal combustion engine spark plug assembly 10, constructed in accordance with one presently preferred aspect of the invention. The assembly 10 has an annular ceramic insulator 12 and an annular metal outer shell 14 surrounding at least a portion of the ceramic insulator 12. A center electrode assembly 16 is received and extends a least partially through the insulator 12 coaxially along a central longitudinal axis 17 of the assembly 10 from a proximal terminal stud 18 to a distal sparking end, also referred to as sparking surface 20 (FIG. 2). A ground electrode 22 has opposite ends 24, 25 attached to diametrically opposite sides 27, 29 of the shell 14, unlike a typical cantilevered configuration, with a ground sparking surface, also referred to as sparking surface 26, being fixed to the ground electrode 22 in axially spaced and centered or substantially centered relation with the central axis 17 from the sparking surface 20 of the center electrode assembly 16 to provide a spark gap 28. With the ground electrode 22 being fixed at least partially about its opposite ends 24, 25, an enhanced heat flow path from the ground electrode 22 to the shell 14 is provided, thereby reducing the potential for electrical erosion and chemical corrosion of the ground electrode sparking surface 26, and further, the potential for movement of ground electrode 22 and sparking surface 26 during use is reduced, thus, maximizing the potential for optimal sparking between the ground and center electrode sparking surfaces 20, 26.

The electrically conductive metal outer shell 14 may be made from any suitable metal, including various coated and uncoated steel alloys. The shell 14 has a generally tubular body with a generally annular outer surface 30 extending between an upper terminal end 31 and a lower fastening end 32. The fastening end 32 has an external threaded region 34 configured for threaded attachment within a combustion chamber opening of a cylinder head (not shown). The shell 14 also has an annular flange 36 extending radially outwardly from the outer surface 30 to provide an annular, generally planar sealing seat 38 for sealing engagement with an upper surface of the cylinder head with the threaded region 34 depending therefrom. The sealing seat 38 may be paired with a gasket 39 to facilitate a hot gas seal of the space between the outer surface of the shell 14 and the threaded bore in the combustion chamber opening. Alternately, the sealing seat 38 may be configured as a tapered seat located along the lower portion of the shell 12 to provide a close tolerance and a self-sealing installation in a cylinder head which is also designed with a mating taper for this style of spark plug seat. The shell 14 also has an attachment portion 41 on an upper portion, such as a tool receiving hexagon or other feature for removal and installation of the spark plug 10 in a combustion chamber opening.

The tubular shell body of the outer shell 14 has an inner wall or surface 40 providing an open cavity 42 extending through the length of the shell between the terminal and fastening ends 31, 32. An internal lower flange 44 extends radially inwardly from the inner surface 40 adjacent the fastening end 32 to provide a lower stop surface 46. The inner surface 40 is represented as having an enlarged diameter region 48 adjacent the terminal end 31 to accommodate the insulator 12. Accordingly, an annular upper flange or shoulder 50 extends radially inwardly from the enlarged diameter region 48 to a reduced diameter region 52 of the cavity 42. The enlarged diameter region 48 extends upwardly from the shoulder 50 to an annular turnover 51 that extends radially inwardly to retain the insulator 12. The shell 14 may also include a deformable buckle zone 53 which is designed and adapted to collapse axially and radially outwardly in response to heating of buckle zone 53 and associated application of an overwhelming axial compressive force subsequent to the deformation of the turnover 51 in order to hold the shell 14 in a fixed axial position with respect to the insulator 12 and form a gas-tight seal between insulator 12 and the shell 14. Gaskets, cement, or other packing or sealing compounds can also be interposed between the insulator 12 and the shell 14 to perfect a gas-tight seal and to improve the structural integrity of the spark plug assembly 10.

The fastening end 32 of the shell 14 has a pair of legs or projections 54 extending axially generally parallel to the central axis 17. The projections 54 extend from the diametrically opposite sides 27, 29 of the shell 14, with recessed surfaces 56 extending between the projections 54. The projections 54 are shown having a width (WP) slightly greater than the width (WG) of the ground electrode 22 and extending a predetermined length axially from the recessed surfaces 56 to established the desired axial parallel width, also referred to as uniform width, of the spark gap 28 both before and after attaching the ground electrode 22 to distal free ends 58 of the projections 54. In addition, outer sides 55 of the projections 54 can be flush with or preferably, as shown, configured to extend radially outwardly of the ends 24, 25 of the ground electrode 22. Accordingly, the distance or length (L) between the outer sides 55 is preferably slightly greater than the overall length (l) of the ground electrode 22.

The projections 54 are formed as monolithic extensions of the shell material, and can be formed in a machining process wherein the recessed surfaces 56 are machined into an end face of the shell material, thereby leaving the projections 54 to extend from the resulting recessed surfaces 56. Of course, it should be recognized that other processes could be used to form the projections 54, including laser cutting or forging, for example.

The insulator 12, which may include aluminum oxide or another suitable electrically insulating material having a specified dielectric strength, high mechanical strength, high thermal conductivity, and excellent resistance to thermal shock, may be press molded from a ceramic powder in a green state and then sintered at a high temperature sufficient to densify and sinter the ceramic powder. The insulator 12 has an elongate body with an annular outer surface 60 extending between an upper terminal or proximal end 62 and a lower distal end 64. The insulator 12 is of generally tubular or annular construction, including a central bore or passage 66, extending longitudinally between an upper mast portion 68 proximate the terminal or proximal end 62 and a lower nose portion 70 proximate the distal end 64. The central passage 66 is of varying cross-sectional diameter, generally greatest at or adjacent the terminal end 62 and smallest at or adjacent the nose portion 70, thereby generally having a continuous series of tubular sections of varying diameter. These sections include a first insulator section which surrounds a connector extension of the terminal stud 18 of the center electrode assembly 16. The first insulator section transitions to an uppermost first insulator shoulder 72 which is in pressing engagement with the turn-over 51 of the shell 14 and in turn transitions to a second insulator section having a diameter which is greater than the diameter of the first insulator section and is housed within the barrel portion of the shell 14. The second section transitions to a third insulator section via a second shoulder 74. The third insulator section preferably has a diameter less than the diameter of the second insulator section, and generally less than the diameter of the first insulator section. The third insulator section transitions to the nose portion 70 via a third insulator shoulder 76 that is configured for abutment with the lower stop surface 46 of the shell 14.

The center electrode assembly 16 includes a center electrode 78 that may have any suitable shape, and is represented here, by way of example and without limitation, as having a body with a generally cylindrical outer surface extending generally between an upper terminal end 79 and a lower firing end 80, and having a radially outward arcuate flair or taper to an increased diameter annular head at the terminal end 79. The annular head facilitates seating and sealing the terminal end 79 within the insulator 12, while the firing end 80 generally extends axially out of nose portion 70. The center electrode 78 is constructed from any suitable conductor material, as is well-known in the field of sparkplug manufacture, such as various Ni and Ni-based alloys, for example, and may also include such materials clad over a Cu or Cu-based alloy core. The center electrode assembly 16 is also shown having a glass seal 82 immediately adjacent the head, an intermediate spring 84 and a resistor/suppressor 86 adjacent the terminal stud 18.

The ground electrode 22 is attached to the projections 54 to establish the predetermined fixed spark gap 28. As such, prior to attaching the ground electrode 22 to the projections 54, the ground electrode sparking surface 26 is attached to the mid-section of the ground electrode 22 midway between the opposite ends 24, 25, as shown in FIG. 3. The ground electrode 22 is constructed as a straight, rectangular member, such as from Inconel 600, having opposite faces 88, 89 facing oppositely from one another along the direction of the axis 17 and opposite sides 90, 91 facing oppositely from one another generally transverse to the axis 17. The faces 88, 89 and sides 90, 91 meet at square shaped edges that extend lengthwise between the ends 24, 25. The length l of the ground electrode 22 is constructed to be equal to or preferably slightly less than the distance L between the outer sides 55 of the projections 54. As such, upon attaching the ground electrode 22 in centered relation between the outer sides 55 and at least partially sunken in the free ends 58 of the projections, the outer sides 55 of the projections 54 extend radially outwardly of the ends 24, 25 of the ground electrode 22 to surround at least a portion of the ends 24, 25. Accordingly, the material of the projections 54 radially outward of the ground electrode 22 facilitates maintaining the ground electrode 22 in its fixed position by resisting movement of the ground electrode 22 in a lateral direction relative to the center axis 17. In addition, as noted above, with the width WG of the ground electrode 22 preferably being slightly less than the width WP of the projections 54, upon attaching the ground electrode 22 to the projections 54, material of the projections 54 extends partially along and outwardly from the sides 90, 91 of the ground electrode 22. As such, at least some material of the projections 54 abuts and confronts the ground electrode 22 along a portion of the sides 90, 91, and thus, the ground electrode 22 is prevented from rotating about the central axis 17 relative to the projections 54, thus, further maintaining the sparking surfaces 20, 26 in their axially spaced and coaxially aligned relation with one another.

The ground electrode sparking surface 26 is constructed having a maximum sparking area facing the center electrode sparking surface 20. This results in large part from having the center electrode fixed at both its opposite ends 24, 25 to the shell 14, which provides an enhance heat sink for the heat generated at the sparking surface 26. Further enhancement of the heat sink is provided by the ends 24, 25 of the ground electrode 22 being at least partially surrounded by the material of the projections 54. Accordingly, the increased heat generated by the maximized surface area of the sparking surface 26 is able to be dissipated without concern of electrical erosion and chemical erosion of the ground electrode sparking surface 26. In addition, the enhanced heat sink provided by the shortened heat flow paths between the ground electrode 22 and the shell 14 provides assurance that the sparking surface 26 will remain fixed to the ground electrode 22. The maximum surface area of the sparking surface 26 is bounded in one aspect by the width WG of the ground electrode 22. Accordingly, the width of the sparking surface 26 is equal to or preferably slightly less than the width WG of the ground electrode. By being slightly less than the width WG of the ground electrode, a continuous bond, e.g. weld joint, can extend completely about the sparking surface 26. The length of the sparking surface 26 is bounded by the length L of the ground electrode 22, however, it is contemplated that a round sparking surface material, e.g. iridium or alloys thereof, including 1.7-2.3% Rh, 0.2-0.4% W, 0.01-0.03% Zr by mass, and the balance Ir, be used. As such, the diameter of the wire is selected to be slightly less than the width WG of the ground electrode 22. For example, if the ground electrode 22 has a width WG of about 3.8 mm, then sparking surface 26 can be provided having a diameter of about 3.75 mm. The sparking surface 26 is attached to one of the faces 88 of the ground electrode 22 using any suitable process of attachment, such as resistance and/or laser welding. The resistance welding can penetrate the sparking surface 26 into the face 88 of the ground electrode 22, such as between about 0.004-0.008" using a weld current between about 6200 to 6600 amps, and then the laser welding can be used to form a circumferential weld joint about the entire circumference of the sparking surface 26. During attachment, the sparking surface 26 is maintained centered between the ends 24, 25 and the sides 90, 91 of the ground electrode 22, and the sparking surface 26 is fixed in substantially parallel relation to the faces 88, 89.

Upon completing the construction of the ground electrode assembly, including attaching the sparking surface 26 to the ground electrode 22, the ground electrode assembly can be attached to the shell 14. The sparking surface 26 of the ground electrode 22 is oriented to face the sparking surface 20 of the center electrode assembly 16 and the associated face 88 of the ground electrode 22 is brought into abutment with the free ends 58 of the projections 54. Given the dimensional relations of the ground electrode 22 (WG, l) and the projections 54 (WP, L) discussed above, upon centering the face 88 of the ground electrode 22 over and between the projection free ends 58, a portion of the free ends 58 extends outwardly in abutment with the sides 90, 91 and the ends 24, 25 of the ground electrode 22. Then, in accordance with one presently preferred method of attaching the ground electrode assembly to the projections 54, a portion of the ground electrode 22 is sunk axially into the projections 54 using a resistance welding process. As shown in FIGS. 2 and 2B, during the resistance welding step, the ground electrode 22 penetrates axially into the free ends 58 of the projections 54 to a predetermined axial depth along the central axis 17 between about 0.001"-0.003" under an axially applied force between about 150 lbs-250 lbs using a resistance weld current between about 6000-7000 amps, though the depth could be increased, if desired. As such, during the resistance welding step, the center and ground electrode sparking surfaces 20, 26 are brought into a predetermined, closely controlled axially aligned and axially spaced relation with one another to provide the desired finished uniform spark gap 28. Further, the ground electrode 22 is fixed against rotation and axial translation relative to the axis 17 by both the material of the projections 54 bounding the ends 24, 25 and the sides 90, 91 of the ground electrode 22, as well as by the weld joint itself.

It should be recognized that other methods of attachment of the ground electrode 22 to the projections 54 are contemplated. For example, rather than causing the ground electrode 22 to become recessed into the free ends 58 of the projections 54 solely via a resistance welding process, generally U-shaped pockets, also referred to as recesses 93, can be preformed, such as by machining or coining, for example, in the free ends 58 and the ground electrode 22 can be placed and fixed in the recesses 93 using other mechanism of attachment, such as laser and/or tack welding, by way of example and without limitation. As such, the preformed recesses 93 can act to self locate the ground electrode 22 and its associated sparking surface 26 in centered and pre-gapped relation with the sparking surface 20 of the center electrode 78 prior to fixing the ground electrode 22 to the projections 54. Further, to ensure the gap 28 is precisely established, a gapping gage can be inserted between the respective center and ground sparking surfaces 20, 26 prior to and while forming the laser weld joint. As such, upon forming the laser weld joint and removing the gapping gage, the spark gap 28 is precisely formed as intended, without need for further processes to establish the desired width of the gap 28. Of course, a combination of pre-forming the recesses 93 and sinking the ground electrode 22 into the projections 54 can be employed as well.

Obviously, many modifications and variations of the present invention are possible in light of the above teachings. It is, therefore, to be understood that within the scope of the appended claims, the invention may be practiced otherwise than as specifically described.

What is claimed is:

1. A spark ignition device, comprising:

a ceramic insulator;

a metal shell surrounding at least a portion of said ceramic insulator and extending along a central axis between an upper terminal end and a lower fastening end, said fastening end having a substantially planar surface extending transversely to said central axis and having a pair of projections diametrically opposite one another extending axially from said substantially planar surface away from said terminal end to free ends;

a center electrode assembly received at least in part in said ceramic insulator; and an elongate ground electrode having opposite sides extending along a length of said ground electrode between opposite ends and having opposite faces with a sparking surface attached to one of said faces, said one face being sunk axially into said free ends of said projections with at least a portion of said opposite sides being surrounded by said projections.

2. The spark ignition device of claim 1 wherein said projections adjoin an outer perimeter of said ground electrode, said outer perimeter being demarcated by a portion of said opposite sides and a portion of said opposite ends of said ground electrode.

3. The spark ignition device of claim 1 wherein a weld joint extends about said outer perimeter.

4. The spark ignition device of claim 3 wherein said weld joint is a resistance weld joint.

5. A method of constructing a spark ignition device, comprising:

providing a ceramic insulator;

disposing a center electrode assembly having a sparking surface at least in part in the ceramic insulator;

providing an annular metal shell having a central axis extending between an upper terminal end and a lower fastening end and forming a pair of projections extending axially from a substantially planar surface adjacent the fastening end to free ends;

providing an elongate ground electrode having opposite sides extending along a length between opposite ends and having opposite faces with a sparking surface attached to one of the faces; and sinking the ground electrode into the free ends of the projections in a welding process and bringing the sparking surface of the ground electrode into a predetermined spaced relation with the sparking surface of the center electrode to form a spark gap therebetween.

6. The method of claim 5 further including performing the welding process in a resistance welding process.

7. The method of claim 5 further including forming generally U-shaped pockets extending axially into the projections with the ground electrode during the welding process.

8. The method of claim 5 further including forming generally U-shaped pockets extending axially into the projections prior to the welding process.

9. The method of claim 5 further including sinking at least a portion of the opposite sides of the ground electrode into the projections.

10. The method of claim 5 further including sinking at least a portion of the opposite ends of the ground electrode into the projections.

11. A method of constructing a spark ignition device, comprising:

providing a ceramic insulator;

disposing a center electrode assembly having a sparking surface at least in part in the ceramic insulator;

providing an annular metal shell having a central axis extending between an upper terminal end and a lower fastening end and forming a pair of projections extending axially from a substantially planar surface adjacent the fastening end to free ends;

providing an elongate ground electrode having opposite sides extending along a length between opposite ends and having opposite faces with a sparking surface attached to one of the faces; and attaching the ground electrode to the projections by sinking the ground electrode into generally U-shaped pockets in the free ends of the projections and bringing the sparking surface of the ground electrode into a predetermined spaced relation with the sparking surface of the center electrode to form a spark gap therebetween.

12. The method of claim 11 further including forming the generally U-shaped pockets by resistance welding the ground electrode to the projections.

13. The method of claim 11 further including preforming the generally U-shaped pockets in the projections prior to attaching the ground electrode to the projections.

14. The method of claim 13 further including welding the ground electrode to the projections after sinking the ground electrode into generally U-shaped pockets.

15. The spark ignition device of claim 1 wherein said ground electrode includes a generally U-shaped pocket extending axially into each of said free ends of said projections.

16. A spark ignition device, comprising:

an insulator having a lower end;

a center electrode disposed in said insulator and having a lower end portion projecting from said lower end of said insulator;

a metal shell supporting said insulator and including a pair of ground electrode support legs that are circumferentially and radially spaced from one another and which extend alongside said lower end portion of said center electrode to free mounting ends thereof;

a ground electrode formed separately from said support legs; said ground electrode extending between and having opposite end portions supported by said support legs; said end portions of said ground electrode having axially opposite end surfaces and laterally opposite side surfaces; and wherein said support legs each have a pocket having at least one side wall portion projecting inwardly toward said center electrode, said end portions of said center electrode being received in said pockets with said at least one side wall portion of each pocket confronting an associated side surface of said ground electrode to locate said ground electrode laterally relative to said center electrode.

* * * * *